US007956266B2

(12) United States Patent
Cleland

(10) Patent No.: US 7,956,266 B2
(45) Date of Patent: Jun. 7, 2011

(54) SNARE MECHANISM FOR A SNARE DRUM

(75) Inventor: Terry Paul Cleland, Beeton (CA)

(73) Assignee: Cleland Instruments Ltd., Beeton, Ontario (CA)

( * ) Notice: Subject to any disclaimer, the term of this patent is extended or adjusted under 35 U.S.C. 154(b) by 98 days.

(21) Appl. No.: 12/432,228

(22) Filed: Apr. 29, 2009

(65) Prior Publication Data

US 2009/0266221 A1 Oct. 29, 2009

Related U.S. Application Data

(60) Provisional application No. 61/048,921, filed on Apr. 29, 2008.

(51) Int. Cl.
*G10D 13/02* (2006.01)

(52) U.S. Cl. ..... 84/413

(58) Field of Classification Search ..... 84/411 R, 84/413–415

See application file for complete search history.

(56) References Cited

U.S. PATENT DOCUMENTS

2009/0133564 A1* 5/2009 Miyajima ..... 84/415

* cited by examiner

*Primary Examiner* — Kimberly R Lockett

(74) *Attorney, Agent, or Firm* — Perry + Currier Inc.; T. Andrew Currier; Stephen J. Perry

(57) ABSTRACT

An internal mechanism for a musical instrument snare drum that supports the snares and allows adjustment of the snare strands in tension as well as relative position to the vibrating member or head of the drum is provided. The mechanism has a support beam that gives a stiffer and more stable base for increased accuracy of all adjustment. The support beam also provides increased guiding for the snare holders during the tension adjustment of the snares. The adjustment of the position of the snares in relation to the vibrating member or drum head is accomplished by deflecting the strands with a bridge like arrangement providing precise placement of the strands for optimum performance.

12 Claims, 10 Drawing Sheets

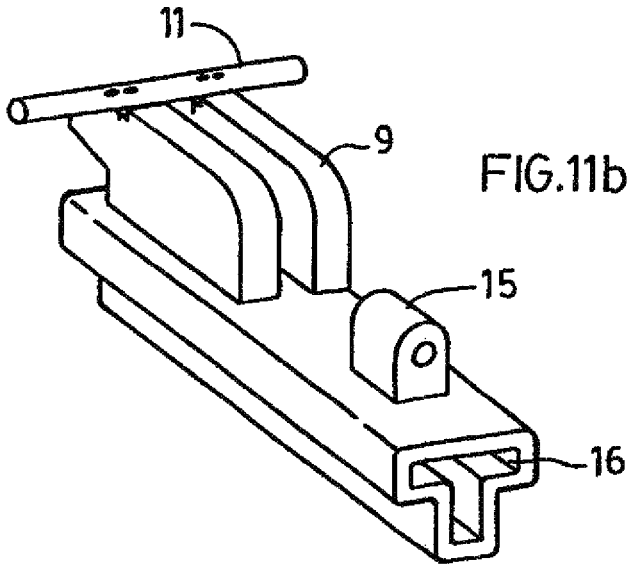
FIG.11b
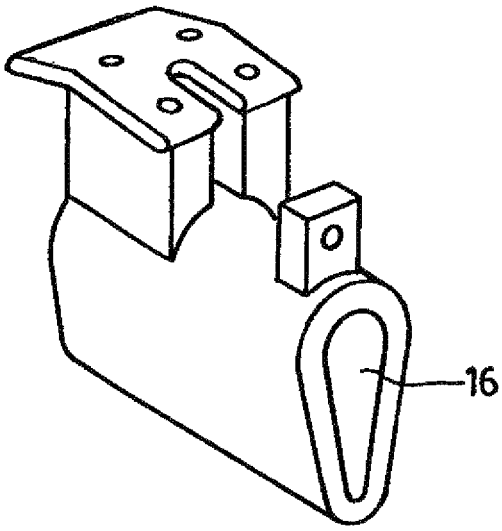
FIG.11c
FIG.11d
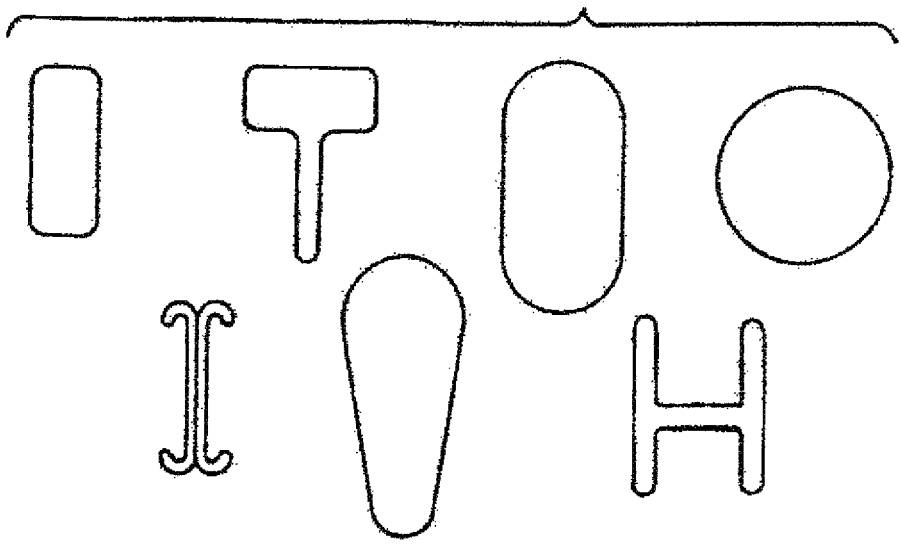

124
120
109
116
190
234
218
194
136
A
128
128
108
104
100
A
198
144
110
132
194
230
222
214
140
190
112
109

124
120
109
116
190
226
234
D
C
210
136
194
104
108
B
100
198
144
110
132
128
194
206
140
C
D
230
190
222
214
112
109

SNARE MECHANISM FOR A SNARE DRUM

CROSS RELATED APPLICATION

The present specification claims priority from U.S. Provisional Patent Application 61/048,921 filed Apr. 29, 2008, the contents of which are incorporated herein by reference.

FIELD

The present specification relates generally to percussion instruments and More particularly relates to snare drums.

BACKGROUND

Snare drums when played produce a particular crisp buzzing sound that is unique to the snare drum. This complex rattle sound is created when strands of wire or some other like material is held just touching the vibrating head of the drum. Precise placement of these snare strands at the right tightness is crucial in attaining and maintaining the desired sound of the drum. The tension of the strands has an effect on their frequency response and reactionary amplitude. The proximity to the head regulates ability of the strands to react to stimulus from the head.

Typical mechanisms have two adjustments, one to stretch or tension the strands and one to place the strands at point that they receive maximum stimulation from the vibrating head. The tension adjustments tend to be an arrangement where there exists some form of screw jack mechanism located and attached to two towers that have the snare strands attached through an intermediary bracket.

In the snare drums used for marching bands where the snare mechanism is located internal to the drum body under the batter head the snare strands can be metal wire. These metal wire strands can take up to ten pounds of force each to yield and the accumulative force on the mechanism can be quite high especially when there are forty wire snares available in the aftermarket. This high force can place a deflection force on the connecting beam that supports the snare carriers in relationship to each other that is sufficient to deform this connecting beam.

Deformation of the beam has a negative effect on the parallel relationship of the two carriers where the snares are attached. Any reinforcement of current designs also becomes an issue as the instrument is carried by the player sometimes for extended periods of time and therefore weight and certainly any addition of weight would be of major concern.

The height or proximity adjustment of the snare strands in relationship to the head is mechanisms that typically move the entire end of the snare attachment point vertically in relationship to the head. In order for these height adjustments to move there is a requirement for a certain amount of clearance between the components in order to allow free movement. This clearance manifests itself as another negative effect on the parallel of the snare carrier towers as the tension on the strands pulls the towers toward each other at their highest point of leverage.

The problem is that any lack of parallel of the snare towers or carriers has an effect on the precision of the tuning of the drum as the ends of the snare strands are where the adjustments are applied and any lean on the towers tends to allow the center of the stands to sag. To combat the sag in the snare strands a higher tension in the strands is required, which then has an effect on the flexibility of the strands.

Any bowing of the mechanism will not allow consistent contact of the snare strands to the head. There can be cases where the solder (or equivalent) used to fasten the strands to the holding bracket can be slightly protruding above the level of the strands and if the strands are bowing away from the head the solder contacts the head at a level below where the strands do and therefore full even contact of the snares to the head is not possible. Another circumstance of effect can be if the snare bracket relies on its shape and dimensions to provide retention to the carriers any bowing in the system can then be applied directly to the strands of the snare.

The foregoing phenomena is illustrated in FIG. 1, which shows a prior art snare drum mechanism.

SUMMARY

In accordance with the principles of the present specification the stiff platform with which to stabilize the desired adjustments is accomplished by the use of a larger section support beam which can be tubular in nature. The larger diameter (in comparison to any tubular or extruded beam currently in use in the market, for said purpose) provides a firm base and also guiding for the movable carriers that the snare strands are fasted to through the intermediate bracket. In the present embodiment of the invention the tube is formed from the lightest, strongest per unit weight material as overall weight reduction of the instrument is desirable. However, as will be apparent to those with skill in the art that beams or tubes or bars formed from other materials can be employed. The advantage of some composite materials is that the nature of the base material can provide an inherent lubricious surface for the components that must interface or slide in adjustment over the tube shape. For non-composite materials a reduced friction bearing material as a bushing may be employed.

In accordance with another aspect of the specification a movable or adjustable stable bridge like surface is used to deflect the snares towards the vibrating head that stimulates these snares.

The adjustable bridge is stabilized by not having the entire mechanism move vertically in relation to the head. The carriage that provides the mounting for the snares is designed as a solid entity to eliminate the "lean" of the mechanisms described above. The adjustable bridge then sits on or hinges on the solid mounting structure for the snare intermediate bracket. These "solid structure" carriages then move in relation to each other on the tubular beam in order to apply overall tension to the snare strands acting through the intermediary snare bracket which hooks on to the provided area of the carriage. Inclusive in the positive mounting area or nest of the carriage provided for the snare intermediate bracket is a shape to the nest area which allows a vertical articulation of the intermediate bracket. This articulation is to provide free movement without damage or strain being placed on the snare strands when the bridge is employed to deflect the strands toward the vibrating head.

As stated above the tendency of adjustment for maximum "snare" activity is for the snares to be as loosely suspended yet positively placed as possible. This adjustment regime often places the snare intermediate bracket in danger of disengagement from the nest provided on the carriage for such purpose. Another aspect is to provide a positive retainer such as a clip or equivalent in order to contain the intermediate bracket in place on the provided nest of the carriage.

An aspect of the specification also provides a larger cross section mounting beam than typically used designed specifically to take high loads and that represent a stiffer more stable platform for mounting the snare mechanism inside a snare drum.

An aspect of the specification also provides an adjustable bridge like device used to control the proximity of snare strands for a snare drum by deflecting the strands toward the membrane or the stimulation source.

An aspect of the specification also provides a mounting nest for the snare intermediate bracket which allows articulation of said bracket.

An aspect of the specification also provides a means of positive retention of the snare intermediate mounting bracket in its nest. An aspect of the specification also provides a positive retention device that allows the articulation as previously mentioned.

An aspect of the specification also provides a friction or ratchet or moveable lock on the various adjustments on the snare mechanism of a snare drum to help retain the desired settings.

An aspect of the specification also provides a changeable ramp or snare intermediate bracket nest to accommodate different snare intermediate brackets. The snare strand tension adjustment device can be located inside the main support beam of the snare mechanism.

An aspect of the specification also provides a return spring on the adjustment devices of the snare mechanism to give artificial feel to the adjustment and to reduce "backlash" in the mechanism for more precise adjustments.

An aspect of the specification provides a snare mechanism for a musical percussion instrument; the musical percussion instrument having a batter head and a percussion chamber having walls and supporting the member; the snare mechanism comprising:

attachment members mountable to the walls within the chamber;

a snare connected to the attachment members and responsive to vibrations to the batter head when the snare is proximal to the batter head;

a snare tensioning mechanism connected to the attachment members and the snare; the snare tensioning mechanism associated with a first actuator such that adjustment of the first actuator selectively causes an increase or decrease in tension of the snare;

a snare positioning mechanism connected to the attachment members and the snare; the snare positioning mechanism associated with a second actuator such that adjustment of the second actuator causes movement of the snare towards or away from the batter head.

The attachment members can be disposed at opposite sides of the chamber.

The snare mechanism can further comprise a first assembly member respective one of the attachment members and a second assembly member respective to an opposite one of the attachment members.

The snare tensioning mechanism can comprise a support beam disposed between the attachment members.

The first assembly member can be a carriage movable in relation to the support beam and the second assembly member is a fixture affixed in relation to the support beam.

The carriage can additionally support a first end of the snare and the fixture supports a second end of the snare.

The first actuator can be a tensioning knob connected to the carriage, such that rotation of the tensioning knob in a first direction urges the carriage away from fixture and increases tension of the snare and rotation of the tensioning knob in a second direction urges the carriage towards the fixture and decreases tension of the snare.

The snare mechanism can further comprise a biasing member joining the carriage and the fixture and urging the carriage towards the fixture.

The snare mechanism can further comprise a threaded element rotatable within a set of interior threads on the tensioning knob; the threaded element terminating in a nut element respective to the carriage, such that rotation of the knob corresponding linearly moves the carriage.

The snare positioning mechanism can comprise a first support ramp respective to the first assembly member and a second support ramp respective to the second assembly member.

The snare positioning mechanism can comprise a transfer shaft connected at a first end to the first assembly member and an opposite end to the second assembly member; the transfer shaft further connected to the second actuator such that rotation of the second actuator causes rotation of the transfer shaft.

The snare mechanism can further comprise a connecting rod movably connected along the transfer shaft and an adjusting bridge connected to a distal end of each connecting rod; each adjusting bridge resting along each respective support ramp; wherein rotation of the second actuator moves each the adjusting bridge along each the ramp.

A clevis can adjoin each connecting rod to the transfer shaft.

Each the connecting rod can be resiliently bendable and a nut can connects each the connecting rod to the transfer shaft.

The transfer shaft can have a first threaded section respective to the first assembly member, and a second threaded section respective to a second assembly member.

DETAILED DESCRIPTION

The mechanism of a "Snare Drum" that produces the "Snare Sound" of a drum, provides means to tension the snare strands that vibrate when stimulated by the vibrating membrane of the drum, and provide a method to support the snare strands in the optimum position in relation to the batter head, vibrating head or membrane in order that they receive the amount of stimulation necessary to react to the membrane and in turn create the desired buzzing "snare" sound considered characteristic of the "Snare Drum."

In order to accurately adjust these snare strands for tension and position the mechanism is structured to be stiff enough to provide consistent settings and robust enough to not yield to the forces placed on it. There can also be a consideration for weight, as in the case of a marching band snare drum which is carried by the player, reducing or at least not adding to the overall weight of the instrument is desirable.

Snare mechanisms traditionally can be located in two locations on the structure of the drum. The first location is on the external surface of the lower head or resonating membrane of the drum. The second location traditionally is internal to the drum shell placed below the surface of the batter head or top membrane of the drum.

This mechanism is intended to be located internal to the drum shell placing the snare strands against the bottom of the batter head, however this mechanism can also be located internal to the drum shell against or above the lower resonating head of the drum.

Figure 1:
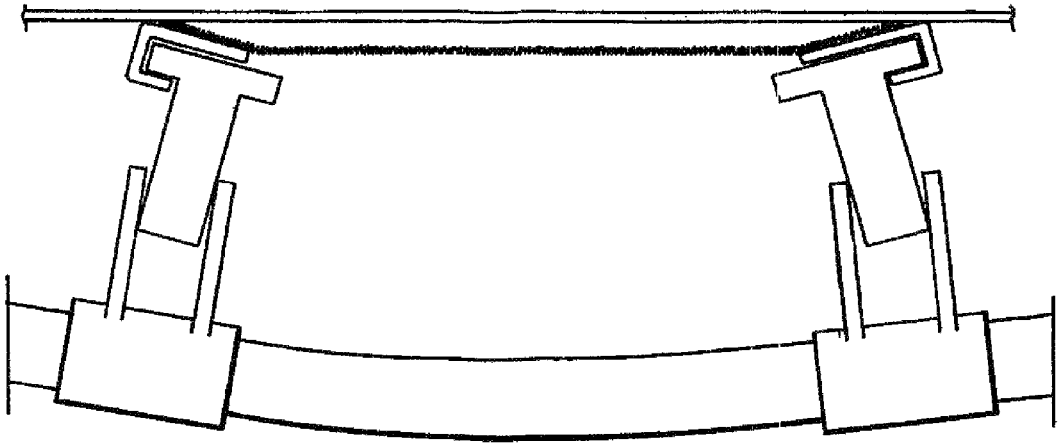
FIG.1 (PRIOR ART)
FIG. 1 is an exaggerated illustration of the type of "leaning" that can occur in traditional, prior art, mechanisms, where there is a stack up of clearances and bending of the support beam and related components under the tension of the snare strands.
Figure 2:
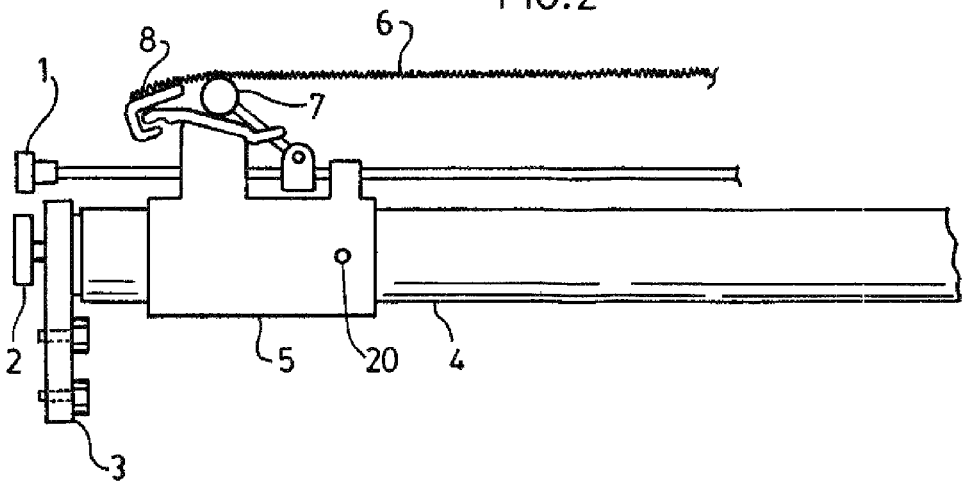
FIG. 2 represents the build up of components of the snare mechanism and support beam in an embodiment.

Accordingly, with reference to FIG. 2*a* snare mechanism, provided in accordance with an embodiment is shown generally at reference 100. The support beam indicated at 4 provides a stiff stable support for the mechanism. The larger the "diameter" section provides higher the resistance to the bending forces placed on the mechanism and the beam itself. These forces are generated by the tensioning of the snare strands plus the load created by the mechanism being pushed against the taught batter head of the drum, and the impact loads from the players sticks. The carriage 5 is the main component of the snare mechanism that interfaces with the support beam. The carriage acts as the chassis that all other components of the mechanism fasten to. The carriage transfers the loads of the snare mechanism to the support beam and intern to the structure of the drum. In FIG. 11*a*, FIG. 11*b*, FIG. 11*c* & FIG. 11*d* are shown different example configurations that could be used as large cross section support beams.

Figure 3:
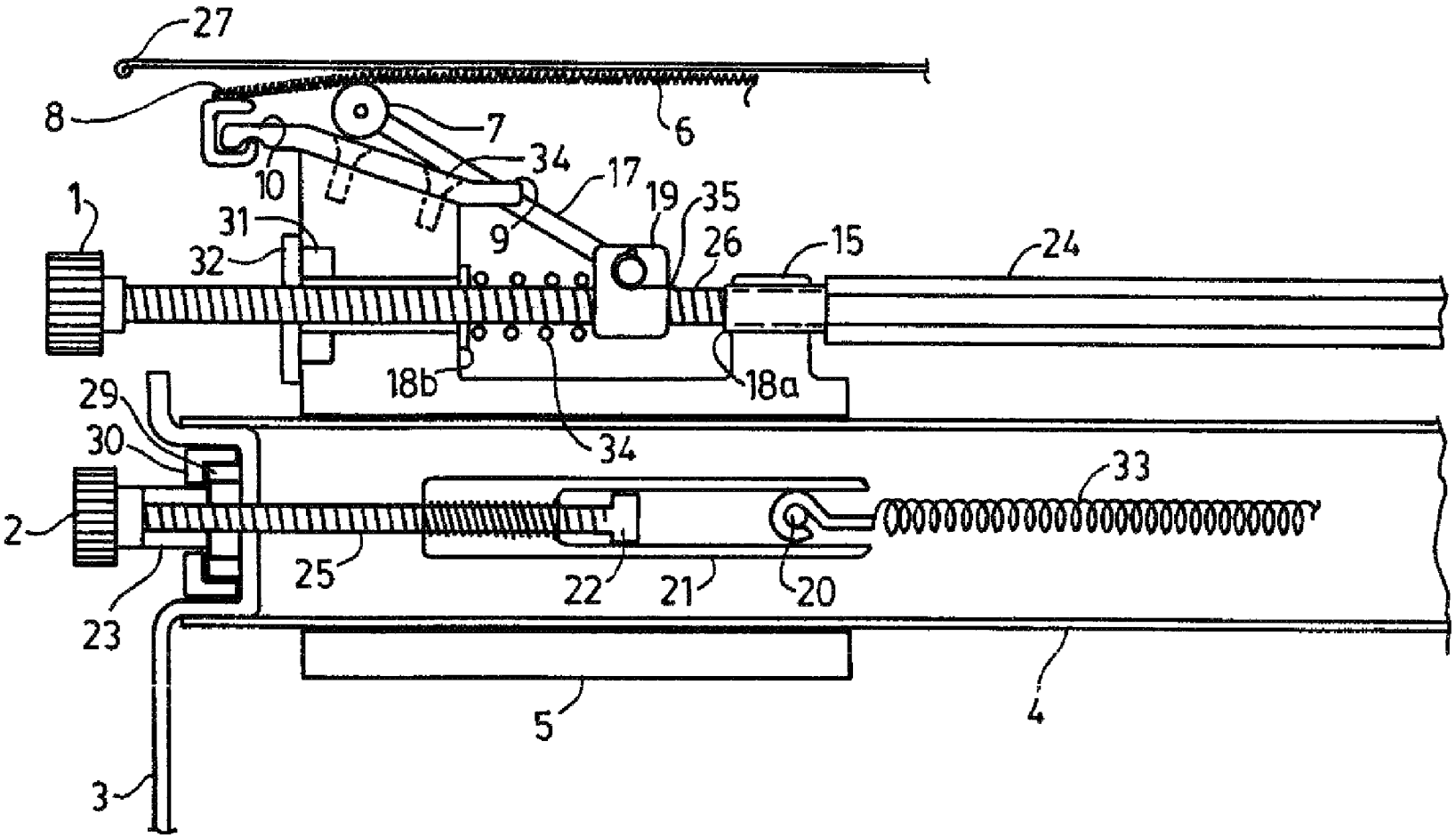
FIG. 3 is a cross section of the snare mechanism showing both the tension and bridge adjusting components.

Accordingly, with reference to FIG. 3 the "tension" adjustment actuated by the tension knob 2 acts directly on the chassis moving it along the beam 4. The actuation of the tension is through a threaded element 25 acting on a nut element 21 that transfers the tension load to the chassis through pin 20. It is desirable for the adjustments to not back off or move once the desired settings are achieved so at position 29 is represented a "nylon" locking button, held in place by cover/cap 30 or a positive lock that is engaged by the "tuner" of the instrument once the desired settings are achieved. In this illustration the head of the threaded element 22 acts as a hard stop to one of the slack adjustment extreme. The loads passed through the beam 4 are transferred to the shell structure through mounting bracket 3. Mounting bracket 3 also acts as the receptor for the hard stop bushing for the high tension setting. To reduce the "backlash" in the tension adjustment a spring 33 is engaged to the pin 20 in each of the snare carriers to provide a positive position return to the carriers.

The snare strand proximity to the membrane adjustment is moved by the rotary action of adjustment knob 1. The knob is connected to the threaded element 26 that in turn acts on clevis nut 19, as this clevis moves along the threaded element the actuating connecting rod 17 being connected to the adjusting bridge 7 moves the bridge up and down the support ramp 9. As adjustable bridge 7 climbs and descends the ramp 9 the bridge deflects the snare strands 6 toward the membrane 27, the proximity adjusting the direct stimulation by the membrane of the snare strands 6. The spring 34 is shown as a positive return for the proximity adjustment and to give more dynamic "feel" to the adjustment. Spring 35 is shown as a torsional spring around the pin in clevis 19 and serves the function of maintaining positive pressure on ramp 9 through applying force on roller bridge 7 transferred to the bridge by connecting rod 17. In order that the two ends of the snare strands are coincidentally adjusted the transfer shaft 24 is directly connected to the adjustment knob 1 through the threaded element 26. Bearing elements 18*a* and 18*b* provide precise guiding of the rotating adjustment elements and smooth movement under load. Position component 31 and cap 31 represent a "nylon" button and cap respectively to maintain the desired settings once chosen. This "lock" device could also be a positive lock in this or in a similarly effective location of the mechanism that is disengaged and engaged respectively by the tuner before and after the desired settings are chosen. Boss 15 provides alignment for the rotating elements. The support ramp 9 is located and held in position by fasteners 34. Various manufacturers of snare strands produce different interface brackets to support the various different numbers and types of snare strand sets that are required, therefore it is desirable that the support or nest be interchangeable to support the various options available for snares.

Figure 4:
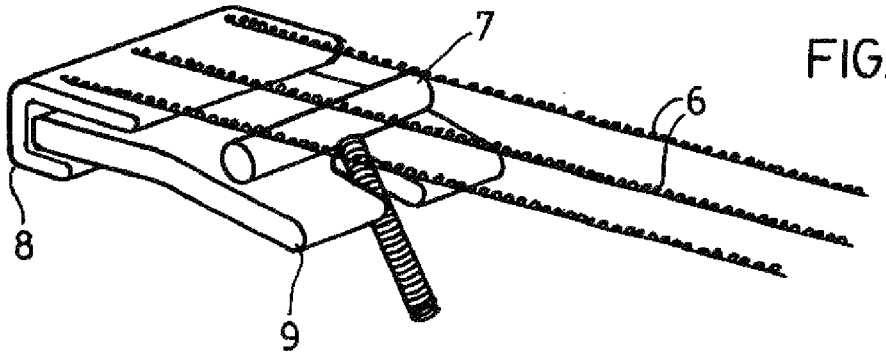
FIG. 4 is a perspective view of one configuration of the bridge adjustor with a support ramp and a round roller shaped bridge.
Figure 5A:
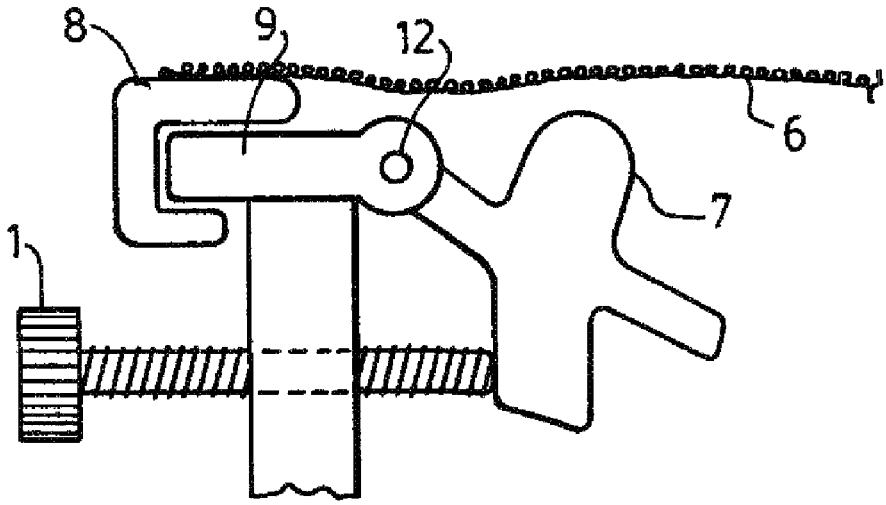
FIG. 5*a*, b, shows two hinge type configurations of the bridge type adjustor
Figure 5B:
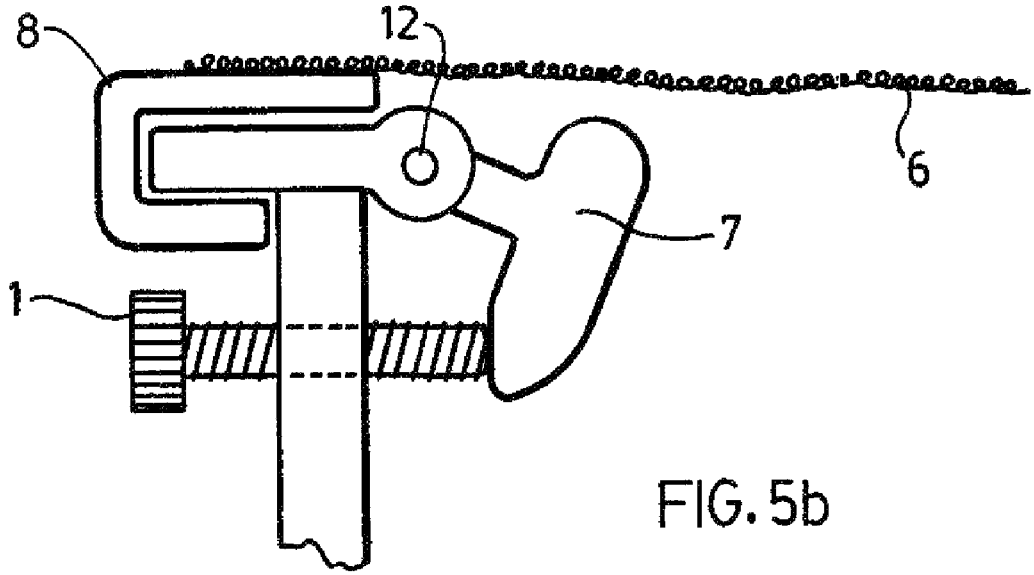

FIG. 5*a* and FIG. 5*b* show in cross section an alternate version of the adjustable bridge, as those skilled in the art will recognize that there are many mechanisms that can provide this type of moving support bridge function to deflect the snare strands. Here 12 represents a pivot or hinge point that can allow bridge 7 movement towards the strands 6 in relation to the static interface bracket 8 through interface bracket nest position, that is a component of support platform 9 when adjustment knob 1 places or removes actuating force FIG. 4 shows a perspective of a consistent section support ramp 9.

Figure 6:
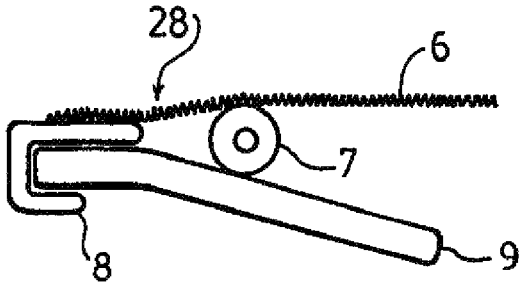
FIG. 6 is a side view of a roller/support ramp configuration with a dimensionally locked shape on the snare strand interfacing bracket nest.

FIG. 6 shows a cross section of element in FIG. 4. The consistent section presents a problem as the bridge 7 progresses under the snare strands 6*a* bending force is created at position 28 as the consistent section 9 constrains the interface bracket 8.

Figure 7:
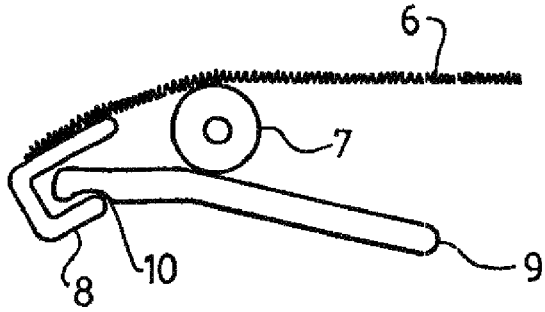
FIG. 7 is a side view of a relieved edge ramp and roller configuration that accommodates articulation of the snare interface bracket.

Accordingly with reference to FIG. 7*a* relief 10 is machined into the consistent section of component 9 and is provided in order to accommodate articulation of snare strand interface bracket 8 as the bridge 7 moves under the snare strands 6.

Figure 8:
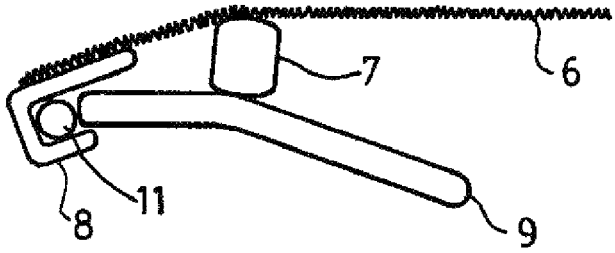
FIG. 8 is a cross section of an alternate configuration that uses a round axle or pin to accommodate snare interface bracket articulation.

In FIG. 8 axle pin 11 is an alternate means of providing articulation, as alternate shape adjustable bridge 7 is shown supporting snare strands 6. Those skilled in the art will know that these are only two examples of applying clearance for articulation of the snare interface bracket 8 and also alternative snare strand interface brackets which would demand different configurations based on specific design and dimensional differences.

Figure 9:
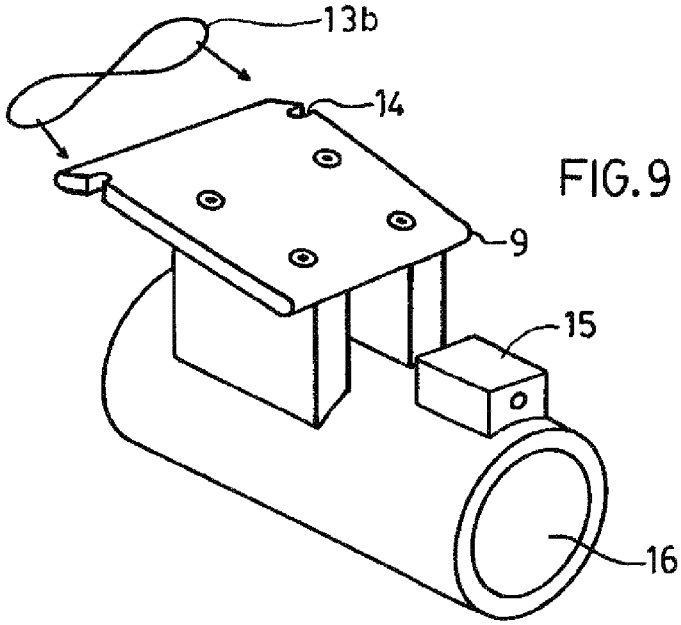
FIG. 9 is a perspective view of one type of snare carriage to accommodate a round support beam, and an elastomer retainer for the snare interface bracket retention
Figure 10:
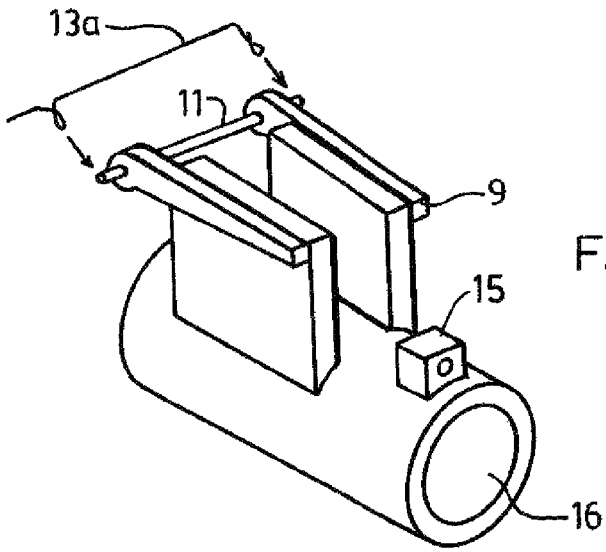
FIG. 10 is a perspective view of a round support beam type snare carriage that uses an axle pin style articulation and a wire clip for retention of the snare interface bracket.
Figure 11A:
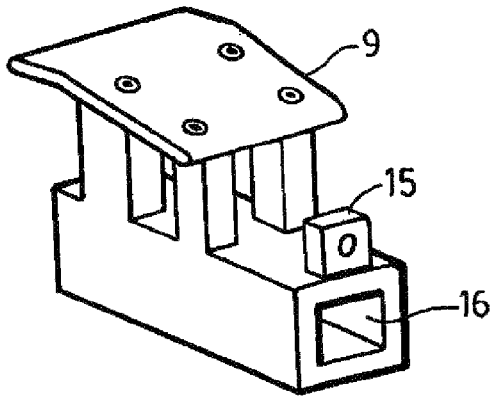
FIG. 11*a, b, c, d* are perspective views of other types of large section/diameter support beam accommodating snare carts with both a ramp and pin style articulation allowance for the snare interface bracket.
Figure 12:
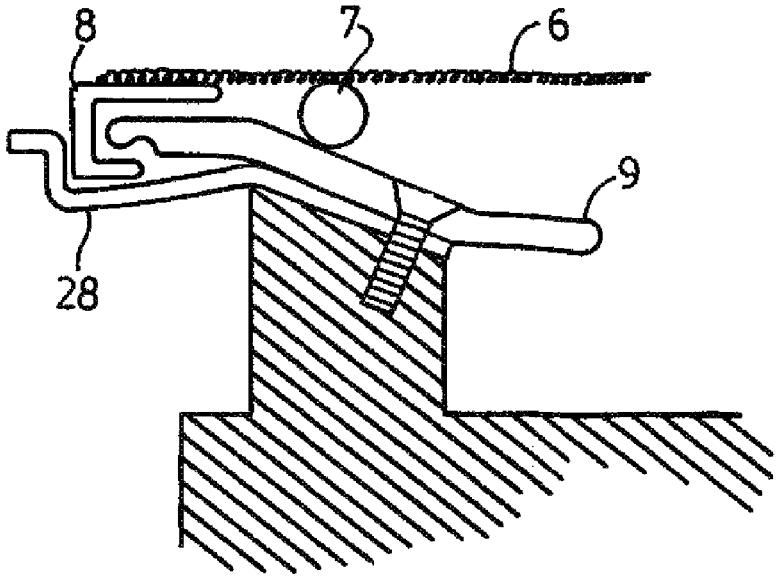
FIG. 12 is a cross sectional view of the snare nesting system, showing the snare strand attachment bracket being held in place against the landing plate by a retaining clip.
Figure 12A:
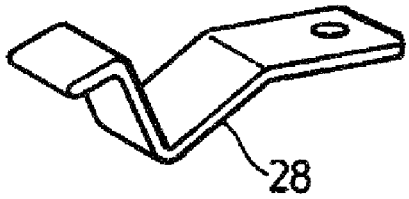
FIG. 12*a* is a perspective view of the retaining clip shown of FIG. 12.

In order to maintain installation position of the snare strand intermediate bracket in its nest position a positive retainer is necessary. Two examples of positive retention 13*a* and 13*b* are shown in FIG. 9 and FIG. 10; the differences are relative to the mechanical configuration of each style of guide ramp for the adjustable bridge. The configuration 13*b* represents an elastomeric element, where as 13*a* represents a metal wire configuration. Another example of a clip retainer 28 is shown in FIG. 12 and in FIG. 12*a* where 28 represents a formed flat spring clip. Those skilled in the art will recognize that there are appropriate clip/retainer configurations to match the snare interface bracket nests of the various possible configurations of the snare carrier.

Referring now to FIGS. 13, 14, 15 and 16, a snare mechanism in accordance with another embodiment is indicated generally at 100. Snare mechanism 100 is a variant on the snare mechanism of the snare mechanism of the snare mechanism of FIG. 2. Therefore further understanding about the principles and structure of snare mechanism 100 can be gleaned from studying the snare mechanism in FIG. 2, and vice versa.

Snare mechanism 100 comprises a snare tensioning mechanism 104 and a snare positioning mechanism 108. In a present embodiment, snare tensioning mechanism 104 and snare positioning mechanism 108 are integrated structurally into a single assembly that can be affixed, directly or indirectly, to an interior wall 109 of a drum 110 or percussion chamber via a first attachment plate 112 and a second attachment plate 116, each of which are disposed at opposite ends of snare mechanism 100.

Figure 15:
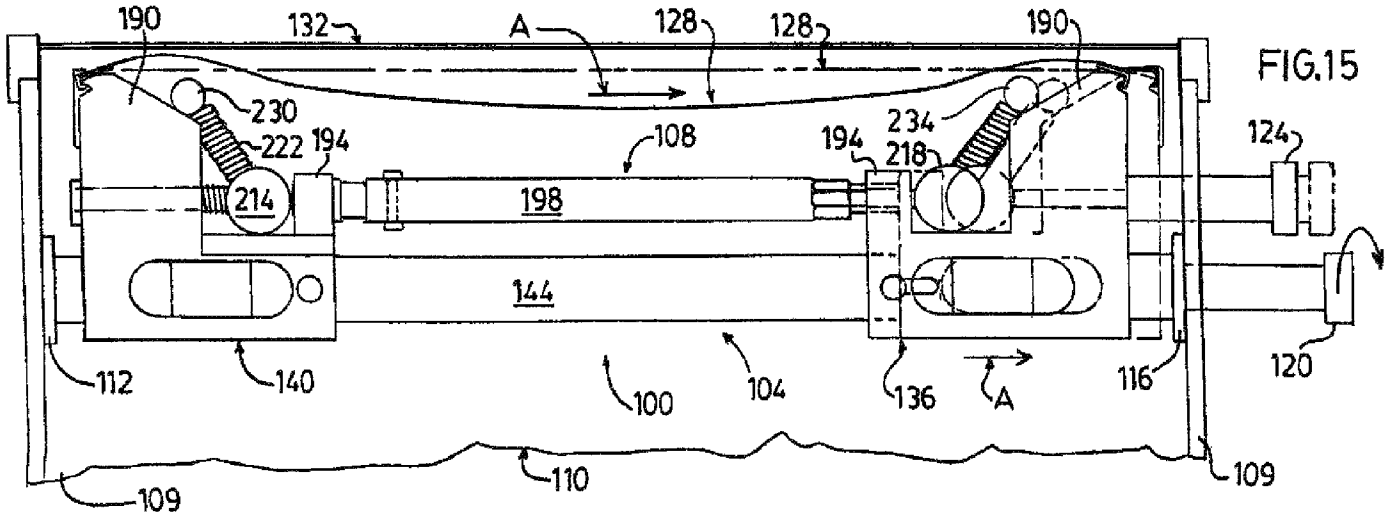
FIG. 15 is another side view of the snare mechanism of FIG. 14 showing movement of the tensioning mechanism.

As best seen in FIG. 15, tensioning mechanism 104 is adjustable via a first actuator implemented in the present embodiment as a tensioning knob 120. When tensioning knob 120 is rotated, the end of snare 128 closest to attachment plate 116 is urged in the direction of arrows A, and away from the opposite end of snare 128 that is closest to attachment plate 112, thereby increasing the tension of snare 128. Rotation of knob 120 in the opposite direction has an opposite effect, thereby decreasing the tension of snare 128.

Figure 16:
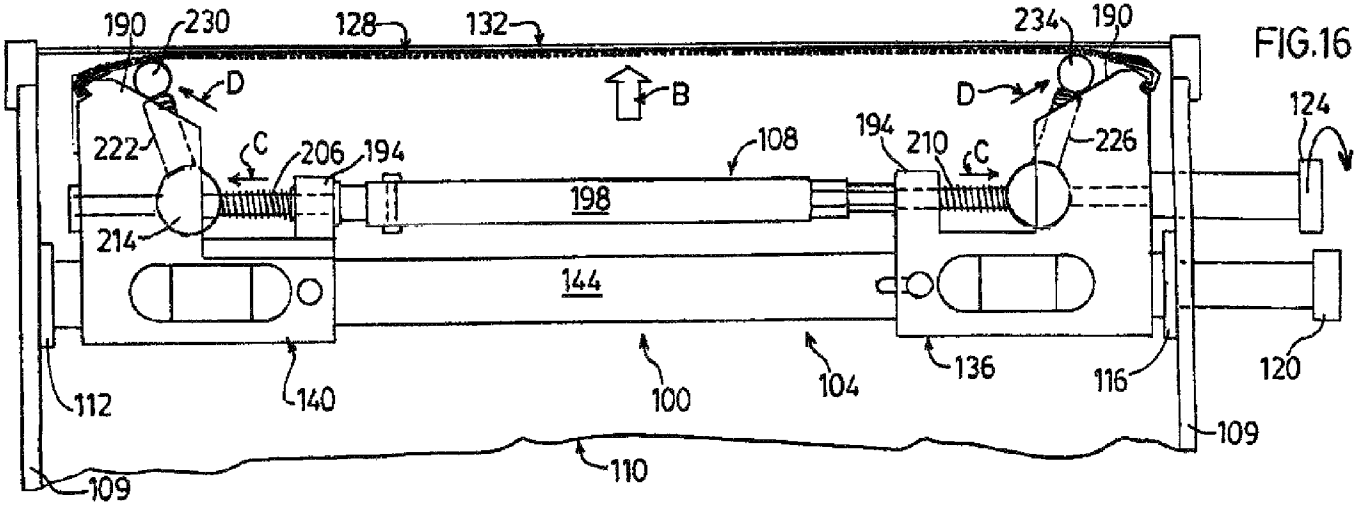
FIG. 16 is another side view of the snare mechanism of FIG. 14 showing movement of the positioning mechanism.

As best seen in FIG. 16, positioning mechanism 104 is adjustable via a second actuator implemented in the present embodiment as a positioning knob 124. When tensioning knob 120 is rotated, the length of snare 128 is urged in the direction of arrow B, and towards the batter head 132 of drum 110, thereby substantially evenly decreasing the gap between batter head 132 and snare 128. Rotation of knob 124 in the opposite direction has an opposite effect, thereby increasing the gap between batter head 132 and snare 128.

Referring generally again to FIGS. 13, 14, 15 and 16, snare mechanism 100 comprises a carriage assembly that itself comprises a movable carriage 136 and a fixture 140. Structurally, carriage 136 and fixture 140 are substantially mirror images of each other. As best seen in FIGS. 15 and 16, carriage 136 is movable along a support beam 144, while fixture 140 remains fixed in relation to support beam 144.

Figure 13:
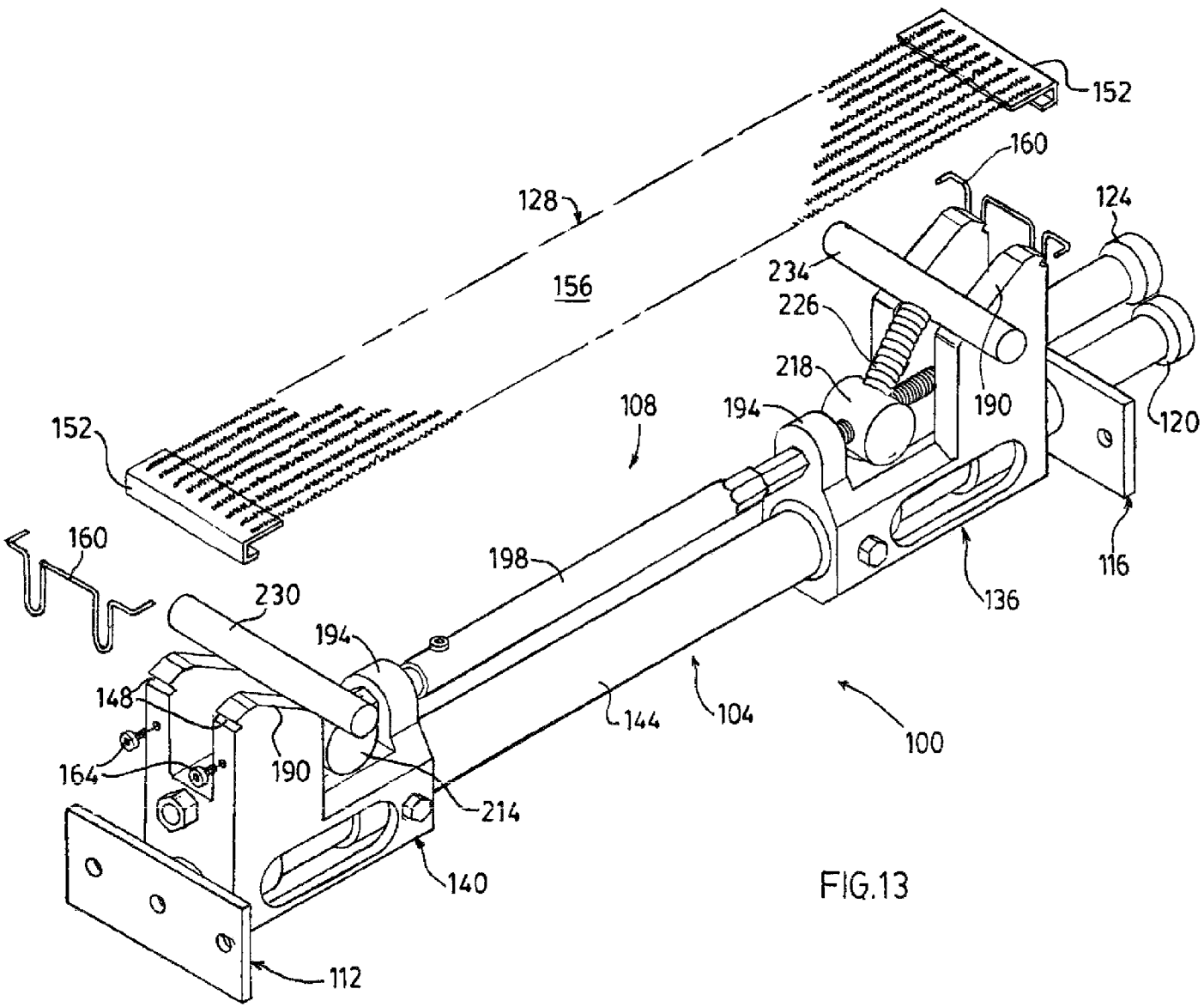
FIG. 13 is a perspective, exploded view of a snare mechanism showing both the tension and bridge adjusting components in another embodiment.

Snare 128 is affixable to carriage 136 and fixture 140. Various structures for effecting such affixing are contemplated, but FIG. 13 shows a presently preferred structure for removably affixing snare 128 to carriage 136 and fixture 140. Each of carriage 136 and fixture 140 comprise notches 148 which can receive the ends of respective interface brackets 152. Interface brackets 152 themselves are part of snare 128, and support one or more snare members 156 therebetween. A pair of retaining clips 160, each of which is affixable to carriage 136 and fixture 140 via nuts 164 or other fasteners, are ultimately used to secure brackets 152 within notches 148. As can be best seen in FIG. 16, notches 148, interface brackets 152 and retaining clips 160 are configured to cooperate so that snare 128 remains affixed to carriage 136 and fixture 140 even during upward travel of snare 128 in relation to snare mechanism 100.

Figure 14:
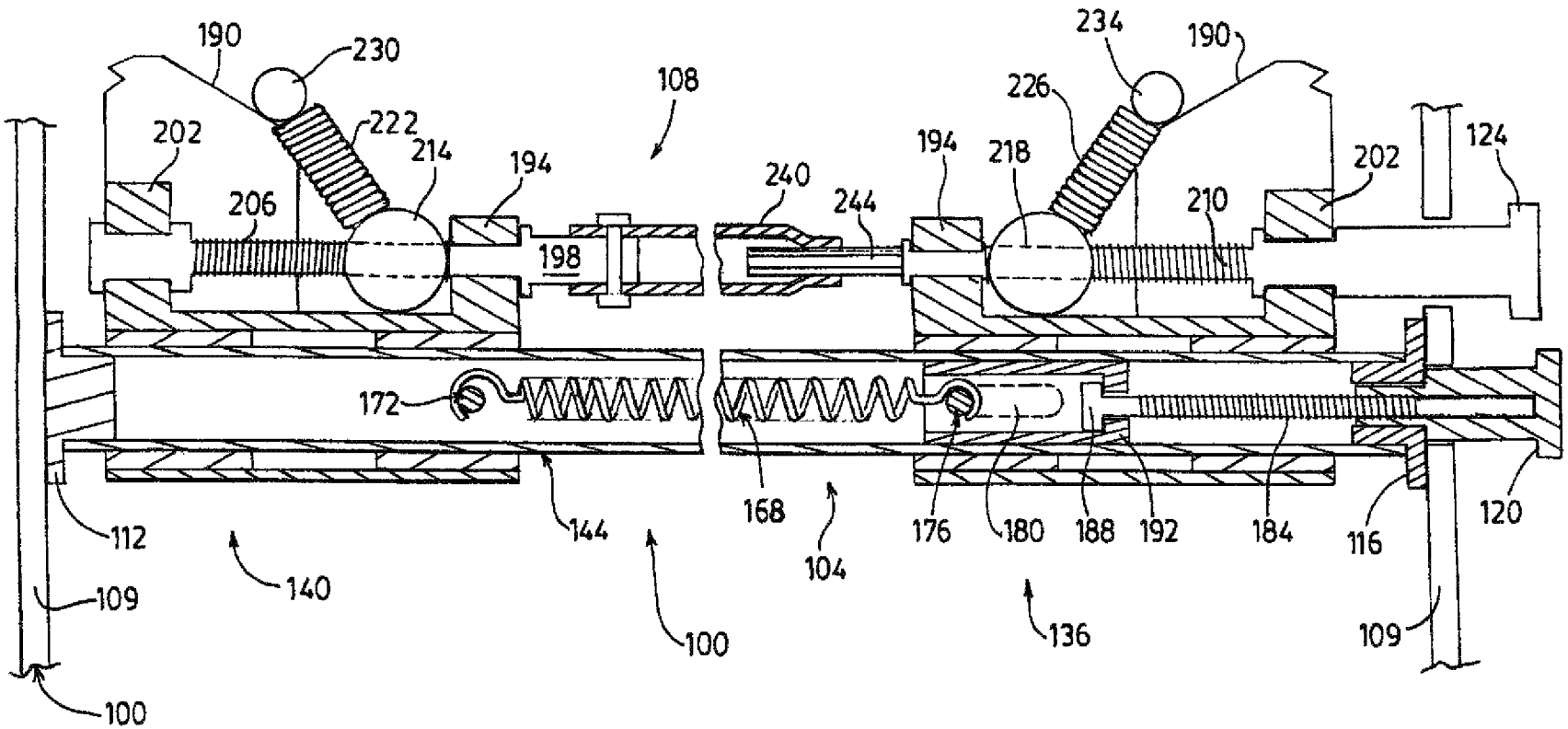
FIG. 14 is a sectional side view of the snare mechanism of FIG. 13.

Turning now to a more detailed discussion of the present embodiment of structure of tensioning mechanism 104, as best seen in FIG. 14, support beam 144 is hollow and houses a spring 168 or other biasing means which urges carriage 136 towards fixture 140, but which can be tensioned outwardly as explained in greater detail below. Support beam 144 is itself affixed at one end to first attachment plate 112 and at the opposite end to second attachment plate 116.

A first support pin 172 affixes support beam 144 to fixture 140, and also provides a first attachment point for spring 168. A second support pin 176 is attached to carriage 136 and provides a second attachment point for spring 168. However, second support pin 176 is not affixed to support beam 144. Instead, support pin 176 can travel within a channel 180 which is provided along a portion of support beam 144 best shown in FIG. 14. The length of channel 180 defines the length of travel of carriage 136 along support beam 144, and generally corresponds to the movement represented by arrow A in FIG. 15.

Also as shown in FIG. 14*a* threaded element 184 acts on a nut element 188 that transfers the tension load through to pin 176 via a donut shaped load transfer plate 192 through which the shaft of threaded element 184 passes. The central axis of knob 120 is hollow and is threaded in order to complementarily receive threaded element 184, such that rotation of knob 120 causes linear movement threaded element 184, thereby acting on carriage 136 and causing carriage 136 to likewise move.

Also as shown in FIG. 14, the distal tip of knob 120 passes through the center of attachment plate 116 and is rotatable therein.

Turning now to a more detailed discussion of the present embodiment of positioning mechanism 108, carriage 136 and fixture 140 each comprise a support ramp 190 and a boss 194 which are pierced for a transfer shaft 198 to pass through. The base of each support ramp 190 also include a bearing 202 which are coaxial with each boss 194. The bearing 202 respective to fixture 140 supports a terminating end of transfer shaft 198, while the bearing 202 respective to carriage 136 supports the opposite end of transfer shaft 198, but this end of transfer shaft 198 merges with knob 124. As best seen in FIGS. 14 and 16, transfer shaft 198 also comprises a fixture threaded portion 206 and a carriage threaded portion 210. Fixture threaded portion 206 resides between the boss 194 and bearing 202 respective to fixture 140, while carriage threaded portion 210 resides between the boss 194 and bearing 202 respective to carriage 136.

Positioning mechanism 108 also comprises a first nut 214 respective to carriage 136, and a second nut 218 respective to fixture 140. Each nut 214, 218 has internal threads complementary to its respective threaded portion 210 and 206. Note that the threads of threaded portion 206 are oriented in the opposite direction to the threads of threaded portion 210, such that rotation of knob 124 in a first direction simultaneously urges nut 214 and nut 218 outwardly, along the directions of arrows C in FIG. 16, while rotation of knob 124 in the opposite direction simultaneously urges nut 214 and nut 218 inwardly, opposite to the direction of arrows C in FIG. 16.

Each nut 214, 218 is pivotally attached to a respective connecting rod 222, 226, and in turn each connecting rod 222, 226 terminates in a respective adjusting bridge 230, 234. Each connective rod 222, 226 is a resiliently bendable, having a normal linear position, but are also bendable into curves of differing diameters. In a present embodiment, each rod 222, 226 is a helical spring with each coil in contact with the next. As best seen in FIG. 16, rotation of knob 124 in a first direction simultaneously urges nut 214 and nut 218 outwardly, along the directions of arrows C in FIG. 16, and at the same time urges adjusting bridges 230, 234 along ramps 190 along the direction of arrow D in FIG. 16. As previously indicated, such movements along arrows C and D, also urges snare 128 along the direction of arrow B, towards batter head 132. Rotation of knob 124 in the opposite direction simultaneously urges clevis 214 and clevis 218 inwardly, opposite to the direction of arrows C in FIG. 16, and at the same time urges adjusting bridges 230, 234 along ramps 190 opposite the direction of arrow D in FIG. 16. As previously indicated, such movements opposite the directions of arrows C and D, also urges snare 128 in the direction opposite of arrow B, away from batter head 132.

Positioning mechanism 108 also comprises a self-leveling feature such that when positioning mechanism 108 is assembled bridges 230 and 234 are substantially co-planar with each other (i.e. level) so that they remain substantially parallel with batter head 132 regardless of the distance between bridges 230 and 234 as adjusted via knob 124. In a present embodiment, the self-leveling feature is effected by implementing transfer shaft 198 in two portions, best seen in FIG. 14. Transfer shaft 198 thus comprises a hollow exterior shaft portion 240 that connects to fixture 140 and threaded portion 206 and a solid interior shaft portion 244 that connects to carriage 136 and threaded portion 210. The junction of solid interior shaft portion 244 and hollow exterior shaft portion 240 are keyed in relation to each other, such that shaft portion 244 and shaft portion 240 rotate together when a rotational force is applied to shaft portion 244 via knob 124. The keying is effected in a present embodiment by configuring shaft portion 244 with a solid hexagonal shape as viewed from its end, and configuring shaft portion 240 with a hollow hexagonal shape as viewed from its end. The hexagonal shape of shaft portion 244 is dimensioned to be slidably received within the hollow hexagonal shape of shaft portion 240. However, the keying of each shaft portion 244 and 240 is also configured such that shaft portion 244 can slide linearly within shaft portion 240. As a result of this configuration, when nut 214 is threaded onto threaded portion 206, and nut 218 is threaded onto threaded portion 210, it is not necessary that each nut 214 and nut 218 be threaded onto the exact same location on its respective threaded portion 206, 210. Rather, each nut 214 and 218 can be threaded onto the same general location of its respective threaded portion 206, 210, and the linear play provided by shaft portion 244 and 240 compensate for any difference in location such that bridges 230 and 234 will self-level.

Variations of the foregoing are contemplated. For example, in a variation either the positioning mechanism or the tensioning mechanism can be omitted. Furthermore, combinations are contemplated, wherein the features of the snare mechanism 100 can be combined with various features of the snare mechanism in FIG. 2, and vice versa.

The foregoing preferred embodiments have been shown and described for the purposes of illustrating the structural and functional principles of the present invention, as well as illustrating the methods of employing the preferred embodiments and are subject to change without departing from such principles. Therefore this invention includes all modifications encompassed within the spirit of the following claims.

The invention claimed is:

1. A snare mechanism for a musical percussion instrument; said musical percussion instrument having a batter head and a percussion chamber having walls and supporting said member; said snare mechanism comprising:

attachment members mountable to said walls within said chamber, said attachment members are disposed at opposite sides of said chamber;

a snare connected to said attachment members and responsive to vibrations to said batter head when said snare is proximal to said batter head;

a snare tensioning mechanism connected to said attachment members and said snare; said snare tensioning mechanism associated with a first actuator such that adjustment of said first actuator selectively causes an increase or decrease in tension of said snare, said snare tensioning mechanism comprises a support beam disposed between said attachment members;

a snare positioning mechanism connected to said attachment members and said snare; said snare positioning mechanism associated with a second actuator such that adjustment of said second actuator causes movement of said snare towards or away from said batter head; and a first assembly member respective one of said attachment members and a second assembly member respective to an opposite one of said attachment members, wherein said first assembly member is a carriage movable in relation to said support beam and said second assembly member is a fixture affixed in relation to said support beam.

2. The snare mechanism of claim 1 wherein said carriage additionally supports a first end of said snare and said fixture supports a second end of said snare.

3. The snare mechanism of claim 2 wherein said first actuator is a tensioning knob connected to said carriage, such that rotation of said tensioning knob in a first direction urges said carriage away from fixture and increases tension of said snare and rotation of said tensioning knob in a second direction urges said carriage towards said fixture and decreases tension of said snare.

4. The snare mechanism of claim 3 further comprising a biasing member joining said carriage and said fixture and urging said carriage towards said fixture.

5. The snare mechanism of claim 3 further comprising a threaded element rotatable within a set of interior threads on said tensioning knob; said threaded element terminating in a nut element respective to said carriage, such that rotation of said knob corresponding linearly moves said carriage.

6. A snare mechanism for a musical percussion instrument; said musical percussion instrument having a batter head and a percussion chamber having walls and supporting said member; said snare mechanism comprising:

attachment members mountable to said walls within said chamber, said attachment members are disposed at opposite sides of said chamber;

a snare connected to said attachment members and responsive to vibrations to said batter head when said snare is proximal to said batter head;

a snare tensioning mechanism connected to said attachment members and said snare; said snare tensioning mechanism associated with a first actuator such that adjustment of said first actuator selectively causes an increase or decrease in tension of said snare;

a snare positioning mechanism connected to said attachment members and said snare; said snare positioning mechanism associated with a second actuator such that adjustment of said second actuator causes movement of said snare towards or away from said batter head; and a first assembly member respective one of said attachment members and a second assembly member respective to an opposite one of said attachment members, wherein said snare positioning mechanism comprises a first support ramp respective to said first assembly member and a second support ramp respective to said second assembly member.

7. The snare mechanism of claim 6 wherein said snare positioning mechanism comprises a transfer shaft connected at a first end to said first assembly member and an opposite end to said second assembly member; said transfer shaft further connected to said second actuator such that rotation of said second actuator causes rotation of said transfer shaft.

8. The snare mechanism of claim 7 further comprising a connecting rod movably connected along said transfer shaft and an adjusting bridge connected to a distal end of each connecting rod; each adjusting bridge resting along each respective support ramp; wherein rotation of said second actuator moves each said adjusting bridge along each said ramp.

9. The snare mechanism of claim 8 wherein a clevis adjoins each connecting rod to said transfer shaft.

10. The snare mechanism of claim 8 wherein each said connecting rod is resiliently bendable and a nut connects each said connecting rod to said transfer shaft.

11. The snare mechanism of claim 8 wherein said transfer shaft has a first threaded section respective to said first assembly member, and a second threaded section respective to a second assembly member.

12. The snare mechanism of claim 8 further comprising a self-leveling mechanism incorporated into said snare positioning mechanism such that said adjusting bridges are self-leveling in relation to each other and such that said snare is substantially parallel to said batter head regardless of a distance between said snare and said batter head.

* * * * *